US011499692B2

(12) United States Patent
Hemker et al.

(10) Patent No.: US 11,499,692 B2
(45) Date of Patent: Nov. 15, 2022

(54) ILLUMINATION DEVICE FOR A VEHICLE WITH POSITIONING MEANS

(71) Applicant: Hella GmbH & Co. KGaA, Lippstadt (DE)

(72) Inventors: Frank Hemker, Lippstadt (DE); Christoph Wierdeier, Werl (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/371,474

(22) Filed: Jul. 9, 2021

(65) Prior Publication Data

US 2021/0372585 A1 Dec. 2, 2021

Related U.S. Application Data

(63) Continuation of application No. PCT/EP2019/051598, filed on Jan. 23, 2019.

(51) Int. Cl.

| | |
|---|---|
| ***F21V 7/00*** | (2006.01) |
| ***F21S 41/39*** | (2018.01) |
| ***F21S 41/148*** | (2018.01) |
| ***F21S 45/47*** | (2018.01) |
| ***F21V 23/00*** | (2015.01) |
| *F21Y 115/10* | (2016.01) |

(52) U.S. Cl.

CPC ..... *F21S 41/39* (2018.01); *F21S 41/148* (2018.01); *F21S 45/47* (2018.01); *F21V 23/004* (2013.01); *F21Y 2115/10* (2016.08)

(58) Field of Classification Search

CPC .. F21S 41/39; F21S 45/49; F21S 41/29; F21S 43/27; F21S 43/37; F21S 43/14; F21S 41/141; F21S 45/47; F21S 41/47; F21S 43/51; F21V 17/06; F21V 17/108; F21V 17/12; F21V 17/14; F21V 17/16; F21V 21/13; F21V 7/00; F21V 21/088; F21V 19/0035; F21V 19/004; F21V 19/0045; F21Y 2115/10; F21K 9/237; F21K 9/00; H01L 23/4093

See application file for complete search history.

(56) References Cited

U.S. PATENT DOCUMENTS

2007/0268703 A1 11/2007 Gasquet et al.
2010/0110677 A1* 5/2010 Stein ..... F21V 13/04 362/235

(Continued)

FOREIGN PATENT DOCUMENTS

AT 514403 B1 6/2015
DE 102007050893 A1 4/2009

(Continued)

*Primary Examiner* — Omar Rojas Cadima
(74) *Attorney, Agent, or Firm* — Husch Blackwell LLP

(57) ABSTRACT

An illumination device for a vehicle is provided, and includes an optical device such as a reflector, with a dome and with a positioning pin. A light emitting assembly is also included with a printed circuit board and a semiconductor light source such as a light emitting diode. The light emitting assembly comprises a bracket with at least one spring for exerting a pretension force on the dome of the optical device. The printed circuit board comprises a positioning hole for receiving the positioning pin and to position the light emitting assembly relative to the optical device.

8 Claims, 7 Drawing Sheets

(56) References Cited

U.S. PATENT DOCUMENTS

| | | | | |
|---|---|---|---|---|
| 2014/0226355 | A1 | 8/2014 | Blandin et al. | |
| 2015/0338049 | A1 | 11/2015 | Cabanne et al. | |
| 2015/0377439 | A1* | 12/2015 | Madelaine ..... | F21S 41/295<br>362/516 |
| 2018/0264994 | A1 | 9/2018 | Stoehr et al. | |
| 2018/0283665 | A1* | 10/2018 | Roth ..... | F21S 43/237 |

FOREIGN PATENT DOCUMENTS

| | | | |
|---|---|---|---|
| DE | 102016213778 | A1 | 2/2017 |
| JP | 6401135 | B2 * | 10/2018 |

* cited by examiner

D - D

E - E

ILLUMINATION DEVICE FOR A VEHICLE WITH POSITIONING MEANS

CROSS REFERENCE

This application claims priority to PCT Application No. PCT/EP2019/051598, filed Jan. 23, 2019, the entirety of which is hereby incorporated by reference.

FIELD OF THE INVENTION

The present invention relates to an Illumination device for a vehicle, comprising an optical device, in particular a reflector, with a dome and with a positioning pin and further comprising a light emitting assembly with a printed circuit board and a semiconductor light source, in particular a light emitting diode.

BACKGROUND OF THE INVENTION

Semiconductor light sources such as light-emitting diodes and lasers are increasingly used in illumination devices for vehicles, in particular headlamps, signal lights, taillights and brake lights of cars. Semiconductor light sources have the advantage over traditional light bulbs, that they are more reliable, have a longer lifetime and that they consume less electrical power at the same light flux intensity. Traditional light bulbs radiate light in omnidirectional manner. Semiconductor light sources radiate light in a more directional manner and therefore the amount of light and electrical power needed is less. Nevertheless, in particular due to the more directional radiation of light from semiconductor light sources, an exact position relative to optical devices such as a reflector or a lens is critical and crucial. A placement of the semiconductor light source outside a designated position relative to the optical devices can lead to significant deviations in shape, direction and intensity of a light cone.

The US 2007/0268703 A1 discloses a vehicle lighting comprising a reflector, a heat dissipation base and a printed circuit board with a light-emitting diode. According to the teaching of the patent a positioning of the reflector relative to the printed circuit board with the light-emitting diode and relative to the heat dissipating base is achieved by pins and studs fitting in or protruding through holes in the printed circuit board and the heat dissipation base. According to the teaching the method for manufacturing the orienting studs allows precise dimensions and tolerances to be obtained.

The AT 51 44 03 B1 discloses an illumination device for a vehicle and a vehicle headlight. To avoid a deformation and a resulting deviation in the light cone when tightening a LED-light source to an optical device a temporary positioning means is proposed. A LED-light source carrier with the LED-light sources is positioned on the optical device. According to the teaching of the patent document a pin and a dome on the optical device is received by cut-outs of the LED-light source carrier. Holding springs on the optical device press the LED-light source carrier against the dome. The LED-light source carrier is thus positioned and temporarily fixed to the optical device by the dome and the pin. A fixed arrangement of the illumination device without screws is proposed. To realize that fixed arrangement, a cooling device is positioned on the LED-light source carrier and a fixation element with clamps is slid onto the cooling device, wherein receiving elements on the dome receive the clamps. By sliding the clamps of the fixation element under the receiving element of the dome a clamping force is generated.

The cooling device, the LED-light source carrier and the optical device are pressed and held together by that clamping force.

Components of an illumination device such as the optical device, the dome, the pin, the light emitting assembly, the LED-light source carrier feature at least slight variations in dimensions from manufacturing. Consequently, it is inevitable to manufacture the components with slight tolerances to ensure that the components can be assembled together into the illumination device. A disadvantage of the tolerances is, that they lead to variations in position of the optical device, in particular the LED-light source, relative to the light emitting assembly and resulting in variations and possibly even a defective light cone.

A further disadvantage of an illumination device with many parts is, that the assembly is time consuming and complex.

BRIEF SUMMARY OF THE INVENTION

It is an object of the present invention to provide a simple and reliable means to precisely position the light emitting assembly relative to the optical device in a predetermined position.

The core of the invention lies in that the light emitting assembly comprises a bracket with at least one spring for exerting a pretension force on the dome of the optical device, and the printed circuit board comprises a positioning hole for receiving the positioning pin and to position the light emitting assembly relative to the optical device.

In a preferable embodiment, the printed circuit board is attached to a baseplate, on a side facing the optical device and cooling fins are attached, in particular riveted, to the baseplate on an opposite side of the base plate facing away from the optical device. The semiconductor light source is expediently located on the printed circuit board facing the optical device. Thus, a particularly compact design of the light emitting assembly with integrated and reliable cooling is achieved. An additional advantage lies in that an assembling of the illumination device is eased.

Advantageously, the bracket is positioned on an opposite side of the light emitting assembly facing away from the optical device and the dome protrudes through an opening in the light emitting assembly in particular an opening in the baseplate and/or an opening in the printed circuit board. This arrangement simplifies the placement of the illumination device onto the optical device. In particular visual inspection is possible during lowering the bracket onto the dome. Expediently the dome is only in contact with the bracket, in particular with the first and/or second positioning spring. The opening is sufficiently large, so that the dome is free of a contact with the printed circuit board or the baseplate.

To achieve a particularly precise and failsafe positioning, the positioning hole comprises a wall forming an end stop to a contact section of the positioning pin. The positioning hole is preferably sufficiently larger and shaped such that the positioning pin fits into the positioning hole without obstruction. The positioning pin may feature a shape to which facilitates an insertion into the positioning hole. As the position is defined by the contact section of the pin and the wall of the positioning hole in the printed circuit board, tolerances and variations of other components are insignificant. In other words, only the wall of the positioning hole forming an end stop for the positioning pin is deterministic for the position of the illumination device relative to the optical device. Wherein the pretension force from the spring causes the positioning.

According to another preferred embodiment with particularly inexpensive, reliable and easy positioning, the bracket is made of a sheet metal, in particular a single piece of sheet metal. In addition, or alternatively the bracket comprises a first spring and a second spring and at least a portion of a pretension force of the first spring acts into a direction perpendicular to a pretension force of the second spring. This allows to easily and automatically position the light emitting assembly relative to the optical device in a two-dimensional plane. Due to the perpendicular pretension force from the first spring and the second spring the light emitting assembly is pushed into on particular direction relative to the optical device and the positioning pin is held in a particular position in the positioning hole.

To avoid tension forces and a deformation of the optical device and printed circuit board, the dome comprises a screw hole and the bracket comprises a bracket hole, and the screw hole and the bracket hole are aligned to one another for receiving a screw and mounting the bracket with the light emitting assembly to the optical device with that screw. In a fixed position the bracket is clamped between the screw and the dome. Thus, a force from the screw for fixing the bracket with the light emitting assembly to the optical device is decoupled from the printed circuit board. This enables a reliable and releasable connection between the optical device and the light emitting assembly for access to or replacement of the components. The bracket hole preferably has a larger diameter than the screw hole to enable an insertion of the screw after positioning of the light emitting assembly relative to the optical device. The fixation with the screw also avoids a movement of the optical device in a z-direction away from the optical device.

To avoid a rotational movement or a rotational misalignment of the light emitting unit relative to the optical device, the printed circuit board comprises a fixation hole for receiving a fixation pin of the optical device. The fixation hole can be of an oval shape such that the cylindrical fixation pin just fits into the widest portion of the fixation hole. Preferably the fixation pin and the positioning pin are spaced apart from one another by at least 20 mm and preferably at the greatest possible distance. The fixation hole and the positioning hole are preferably located on opposite far ends of the printed circuit board.

To keep tolerances small and the positioning of the printed circuit board with the semiconductor light source particularly precise, the positioning pin and/or the fixation pin are made from one piece with the optical device. Thus, variations in position from the mounting of the fixation pin or the positioning pin to the optical device is excluded.

The aforementioned components, as well as the claimed components and the components to be used in accordance with the invention in the described embodiments, are not subject to any special exceptions with respect to their size, shape, material selection and technical concept such that the selection criteria known in the pertinent field can be applied without limitations.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
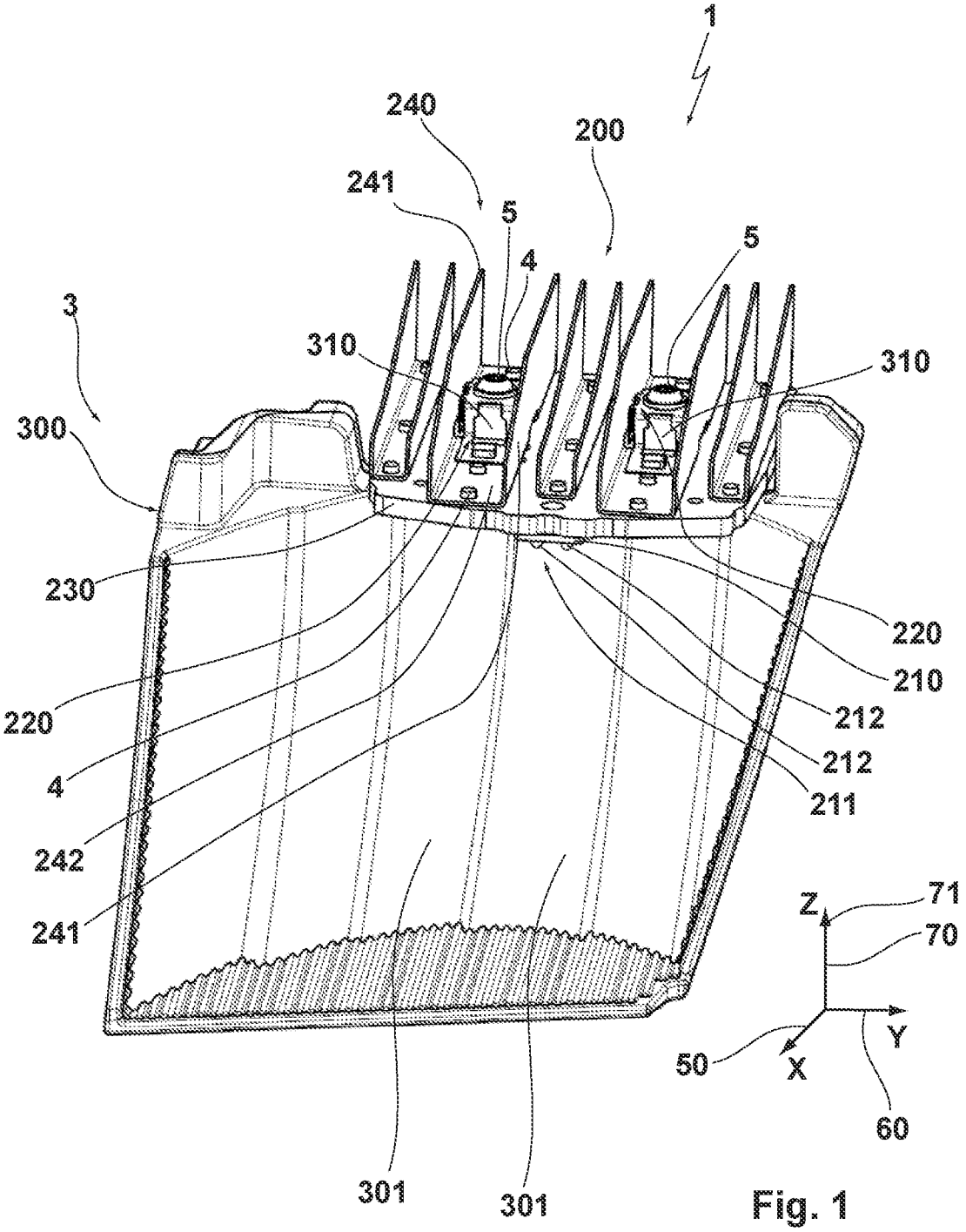
FIG. 1 is a perspective view an optical device in the embodiment of a reflector with a light emitting assembly positioned on and mounted to the reflector.

FIG. 1 depicts an illumination device 1 with a light emitting assembly 200 and an optical device 3 in the embodiment of a reflector 300. The light emitting assembly 200 is attached to the reflector 300 and comprises a printed circuit board 210, a bracket 220, a base plate 230, a cooling device 240. The light emitting assembly 200 with the printed circuit board 220 and the baseplate 230 extends in a x-y plane. The x-y plane comprises of a x-axis 50 and a y-axis 60. The printed circuit board 210 is attached to the baseplate 230 on a side facing the reflector 300. The printed circuit board 210 holds a semiconductor light source 211 with an array of light emitting diodes 212 facing the reflector 300. Thus, light from the light emitting diodes 212 can be emitted into the reflector 300 and onto precisely shaped optical surfaces 301 of the reflector. The light reflected by the optical surfaces 301 forms a light cone of desired shape and light intensity distribution. The cooling device 240 is formed from a piece of sheet metal and comprises of two cooling fins 241 and a cooling base 242. The cooling base 242 is attached to the baseplate 230 on the side facing away from the reflector 300 by rivets 4. The cooling fins 241 extend perpendicular from the cooling base 242 away from the reflector 300 parallel to a z-axis 70 in z-direction 71. The brackets 220 are positioned between two neighbouring cooling fins 241 on the opposite side of the base plate 230 facing away from the reflector 300. The brackets 220 are mounted to the cooling base 242 and the baseplate 230 by rivets 4. The bracket 220 is located above a here not visible opening in the light emitting assembly 200. A dome 310 of the reflector 300 protrudes through the here not visible opening and into the bracket 220. A here not visible first spring and a second spring of the bracket 220 exert a force on the dome 310 of the reflector 300 and thus pushes and positions the light emitting assembly 200 relative to the reflector 300 in the x-y plane. The light emitting assembly 200 and the reflector 300 are connected by a screw 5.

Figure 2:
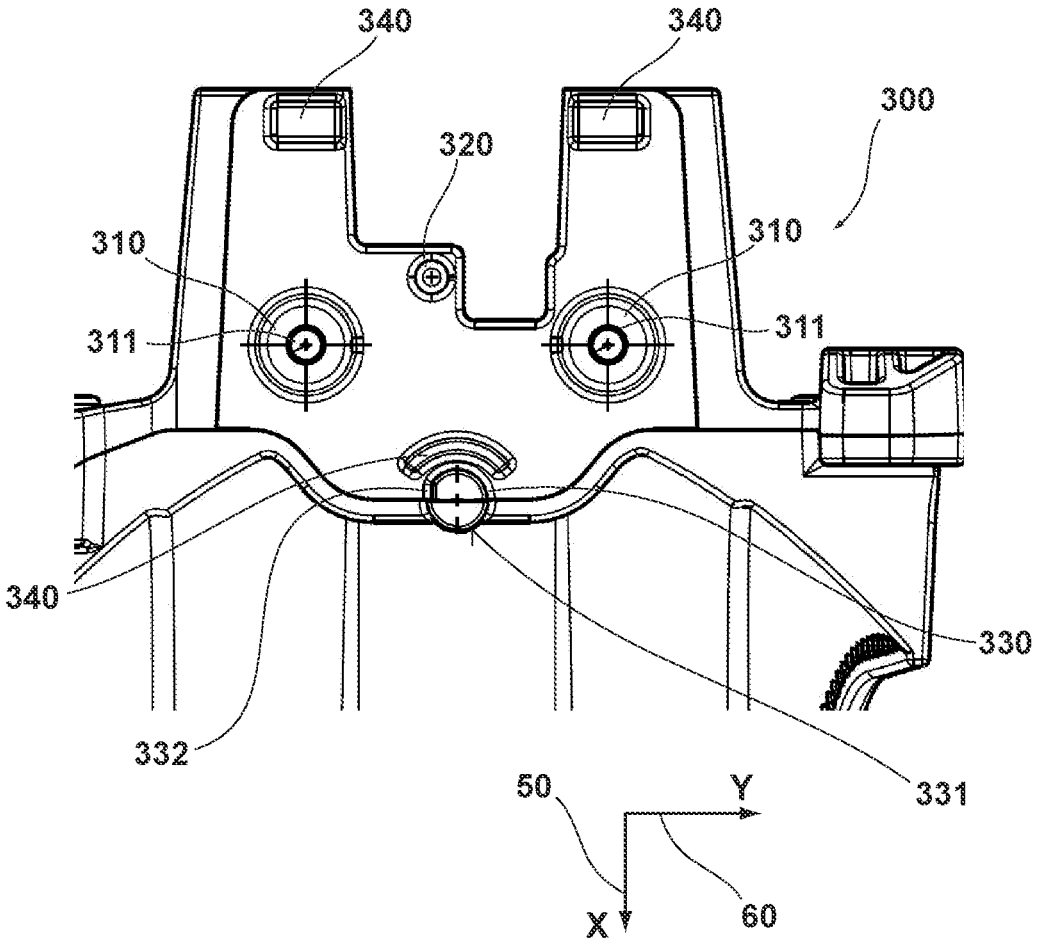
FIG. 2 is a view onto a receiving section of the reflector with a dome, a positioning pin and a fixation pin.

FIG. 2 depicts a portion of the reflector 300 for receiving the light emitting assembly. The reflector 300 comprises a number of pads 340 which are distributed in an x-y plane and on which the printed circuit board rests when positioned and fixed to the reflector 300. The x-y plane is formed from the x-axis 50 and y-axis 60. The light emitting assembly (according to FIG. 1) can thus be lowered onto the reflector 300 in a direction parallel to a z-axis for positioning and fixation. The z-axis runs perpendicular to the x-y plane. The dome 310, the fixation pin 320 and a positioning pin 330 of the reflector 300 extend perpendicular to the x-y plane away from the reflector 300. The dome 310 comprises a screwhole 311 for receiving the screw. The dome 310 and the fixation pin 320 are shaped cylindrically. The positioning pin 330 is mainly shaped cylindrically. A round contact section 331 occupies one quarter of a circular section of the positioning pin 330. The positioning pin 330 also features a recess 332 to ease an insertion of the positioning pin 330 into a here not visible positioning hole. The fixation pin 320 and the positioning pin 330 are located at a distance from one another in the x-y plane.

Figure 3:
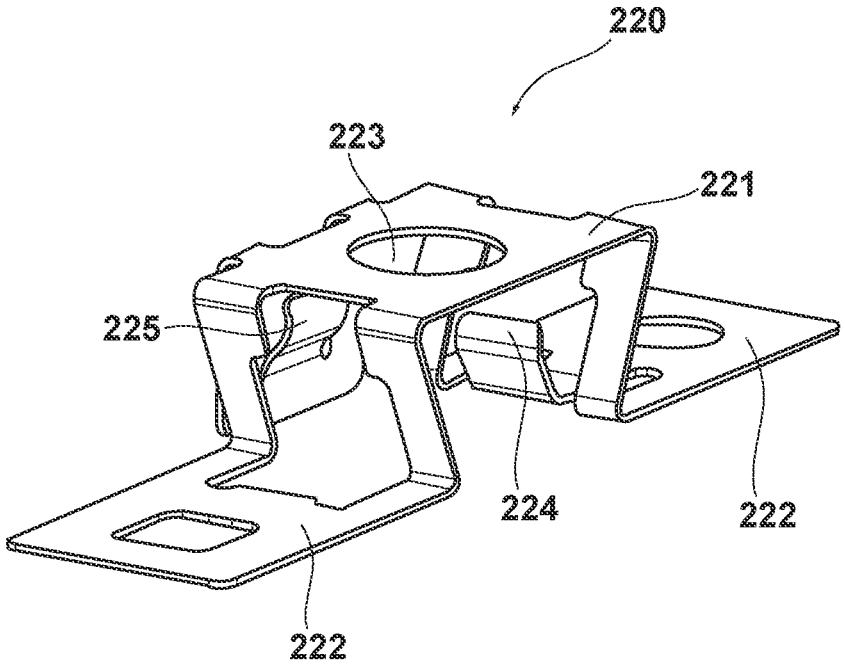
FIG. 3 is a perspective view on an isolated bracket with a first spring and with a second spring.

FIG. 3 depicts the bracket 220 in an isolated perspective view. An elevated support 221 is formed between two legs 222 of the bracket 220 and a bracket hole 223 for receiving the screw (according to FIG. 1) is cut out from the support 221. The first spring 224 and the second spring 225 are formed out of the metal bracket 220 and are arranged in a space between the legs 222 and the support 221, wherein the first spring 224 and the second spring 225 face in perpendicular directions. Thus, the pretension force of the first spring 224 and the pretension force of the second spring 225 is directed in perpendicular directions. A space between the legs 222, the support 221 and the first spring 224 and the second spring 225 is suited to receive the dome of the reflector (according to FIG. 2).

Figure 4A:
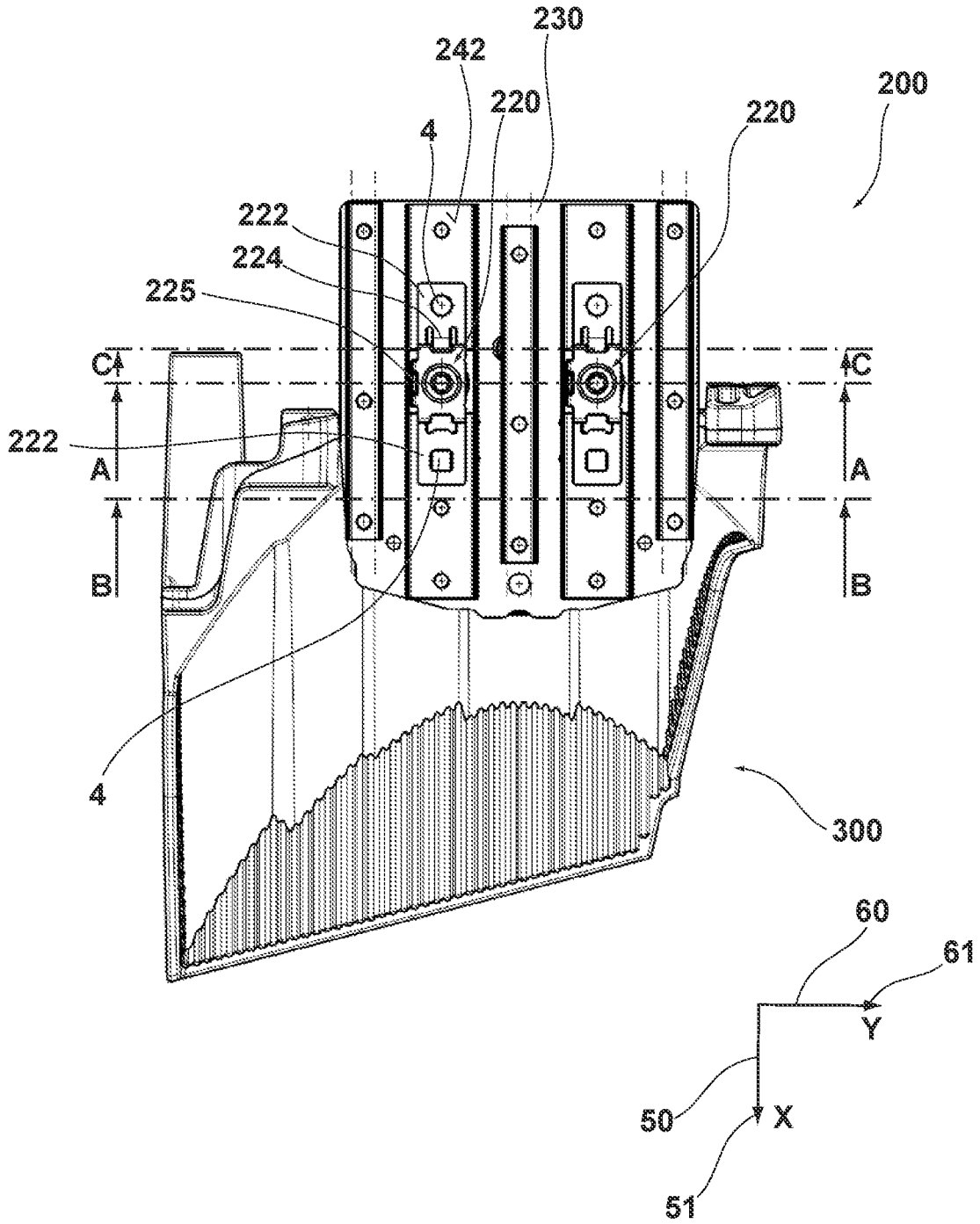
FIG. 4*a* is a view onto the light emitting assembly mounted to the reflector.

FIG. 4*a* depicts the light emitting assembly 200 positioned relative to the reflector 300 by the bracket 220. The bracket 220 is manufactured from a single piece of metal and comprises two legs 222 and the first spring 224 and the second spring 225. The two legs 222 are located on opposite sides of the bracket 220 and mounted to the base plate 230 and the cooling base 242 on an opposite side facing away from the reflector 300 by rivets 4. The pretension force of the first spring 224 acts in an x-direction 51 parallel to the x-axis 50 and a pretension force of the second spring 225 acts in a y-direction 61 parallel to the x-axis 60. The base plate 230 is positioned and extends in the x-y plane composed of the x-axis 50 and the y-axis 60.

Figure 4B:
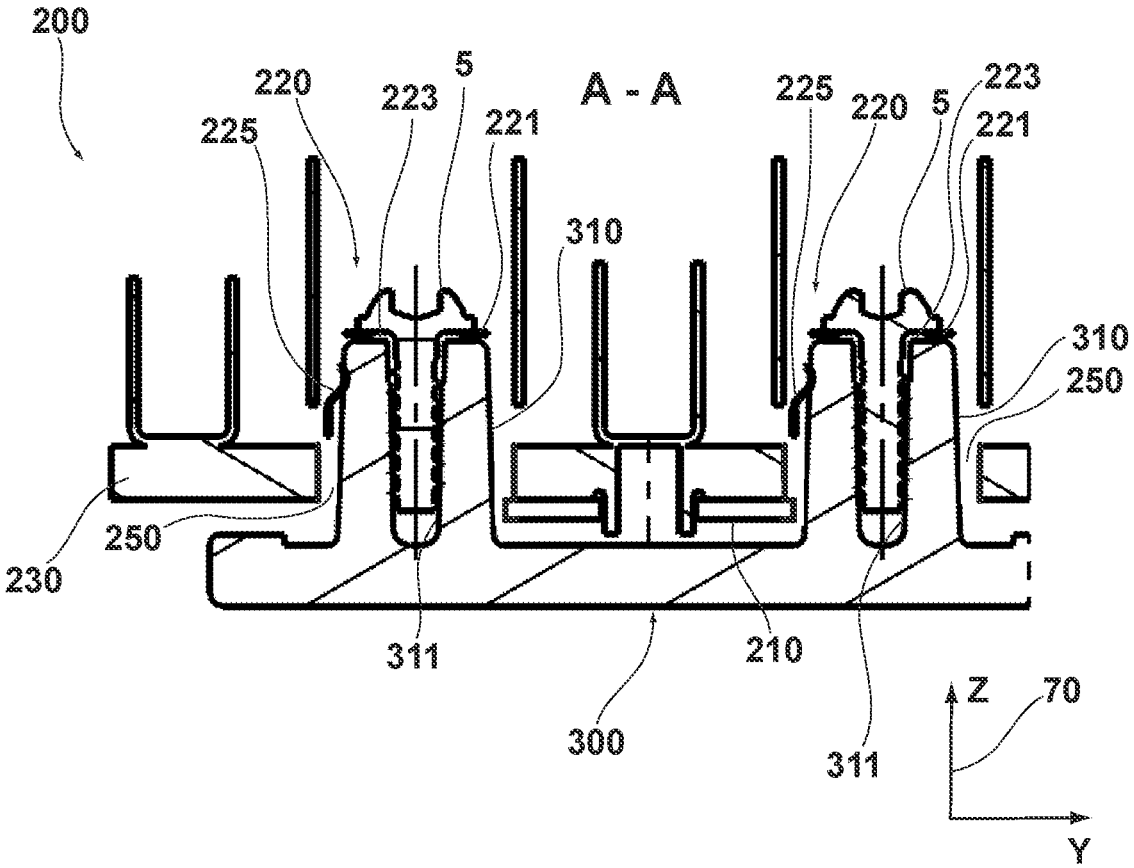
FIG. 4*b* is a side-view onto a section along section line A-A according to FIG. 4*a* with the dome of the reflector traversing through an opening in the light emitting assembly.

FIG. 4*b* depicts in a side view a section along section line A-A according to FIG. 4*a* with the dome 310 of the reflector 300 and the light emitting assembly 200 with the support 221 and the second spring 225 of the bracket 220. The dome 310 traverses an opening 250 in the base plate 230 and is received in the bracket 220. The pretension force of the second spring 225 pushes the dome 310 in the y-direction wherein the dome is floating in the opening. The dome 310 is free of contact with the baseplate 230 and free of contact with the printed circuit board 210. The screw 5 is screwed into a centrally located circular screwhole 311 of the dome 310 in a direction parallel to the z-axis 70. The screw 5 traverses the bracket hole 223 of the bracket 220 and clamps the support 221 to the dome 310. The reflector 300 is thus fixed to the light emitting assembly 200 in a desired and predetermined position.

Figure 4C:
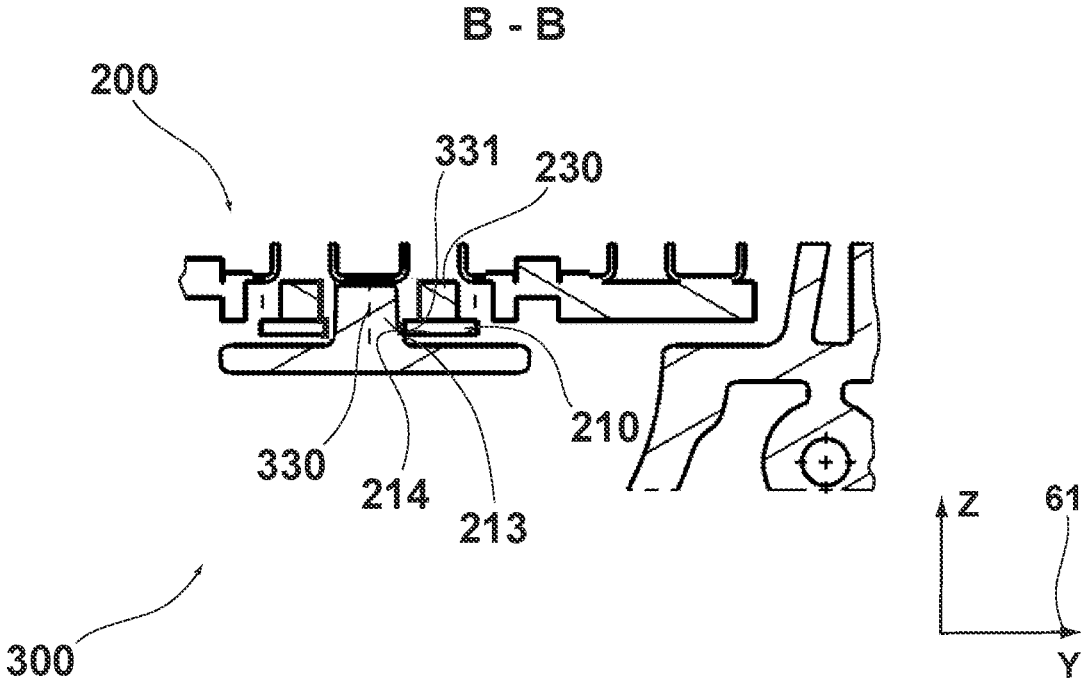
FIG. 4*c* is a side-view onto a section along section line B-B according to FIG. 4*a* with the fixation pin of the reflector positioned in a positioning hole in a printed circuit board of the light emitting assembly.

FIG. 4*c* depicts in a side view a section along section line B-B according to FIG. 4*a* with the positioning pin 330 of the reflector 300 inserted and received in the positioning hole 213 of the printed circuit board 210 of the light emitting assembly 200. The pretension force of the second spring (according to FIG. 4*b*) pushes the contact section 331 of the positioning pin 330 in the y-direction 61 and against a wall 214 of the positioning hole 213. The wall 214 thus forms an end stop to the positioning pin 330 for precise positioning of the reflector 300 relative to the light emitting assembly 200. Only variations and tolerances of dimensions of the contact section 331 and the wall 214 and a variation in position of the light emitting diode on the printed circuit board 210 affect the position. Consequently, a very precise positioning of the light emitting diodes relative to the optical surfaces of the reflector is possible.

Figure 4D:
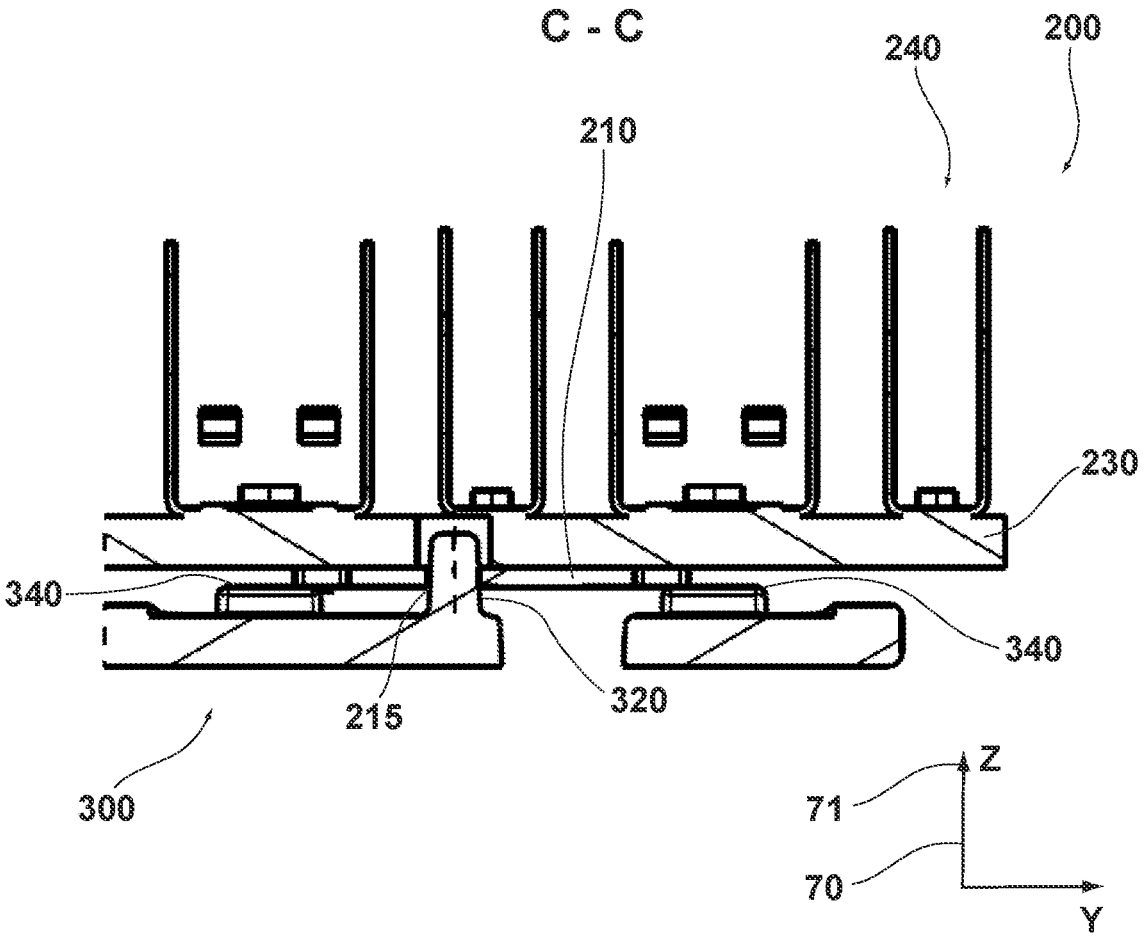
FIG. 4*d* is a side-view onto a section along section line C-C according to FIG. 4*a* with the fixation pin of the reflector positioned in a fixation hole in the printed circuit board.

FIG. 4*d* depicts in a side view a section along section line C-C according to FIG. 4*a* with the light emitting assembly 200 with the baseplate 230. The printed circuit board 210 is attached to the baseplate 230 on the reflector 300 facing side. The cooling device 240 is attached to the baseplate 230 on the opposite side facing away from the reflector 300. The printed circuit board 210 directly rests on pads 340 of the reflector 300. Thus, a precise positioning of to the printed circuit board 210 with the light emitting diodes relative to the reflector 300 in a z-direction 71 parallel to the z-axis 70 is ensured. The fixation pin 320 of the reflector 300 is received by and positioned in a fixation hole 215 in the printed circuit board 210. The fixation pin 320 is in direct contact with the printed circuit board 210. A rotational movement of the light emitting assembly 200 relative to the reflector 300 around a rotational axis parallel to the z-axis 70 is avoided by two spaced apart points of connection and fixation. Firstly, the connection between the printed circuit board 210 and the positioning pin (according to FIG. 4*c*) and secondly the connection between the printed circuit board 210 and the fixation pin 320.

Figure 5A:
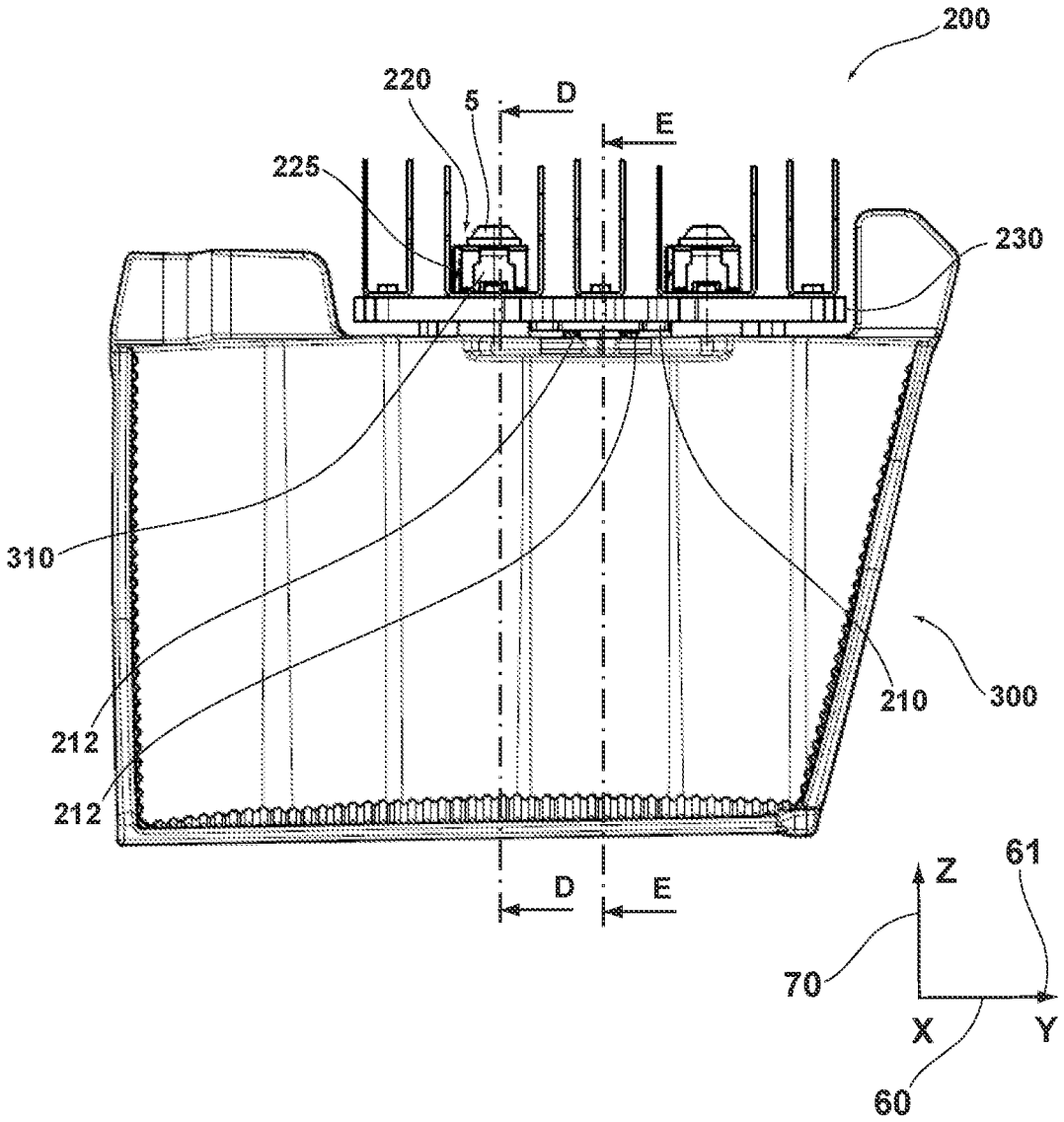
FIG. 5*a* is a frontal view on the illumination device with the light emitting assembly mounted to the reflector.

FIG. 5*a* shows the bracket 220 connected to the baseplate 230 in a view along the x-axis in the x-y plane. The bracket 220 comprises the second spring 225. The printed circuit board 210 with the light emitting diode 212 is mounted to the baseplate 230 on the reflector facing side. The dome 310 of the reflector 300 traverses through the base plate 230 and is received in the bracket 220. The second spring 225 exerts a force on the dome 310 parallel to the y-axis 60 and thus pushes the dome 310 in the y-direction 61. A predetermined and desired relative position between the light emitting assembly 10 and the reflector 50 in the y-direction 61 is thus automatically achieved. The reflector 300 and the light emitting assembly 200 are connected by the screw 5 in that position. The screw 5 is screwed into the dome 310 in a direction parallel to the z-axis 70.

Figure 5B:
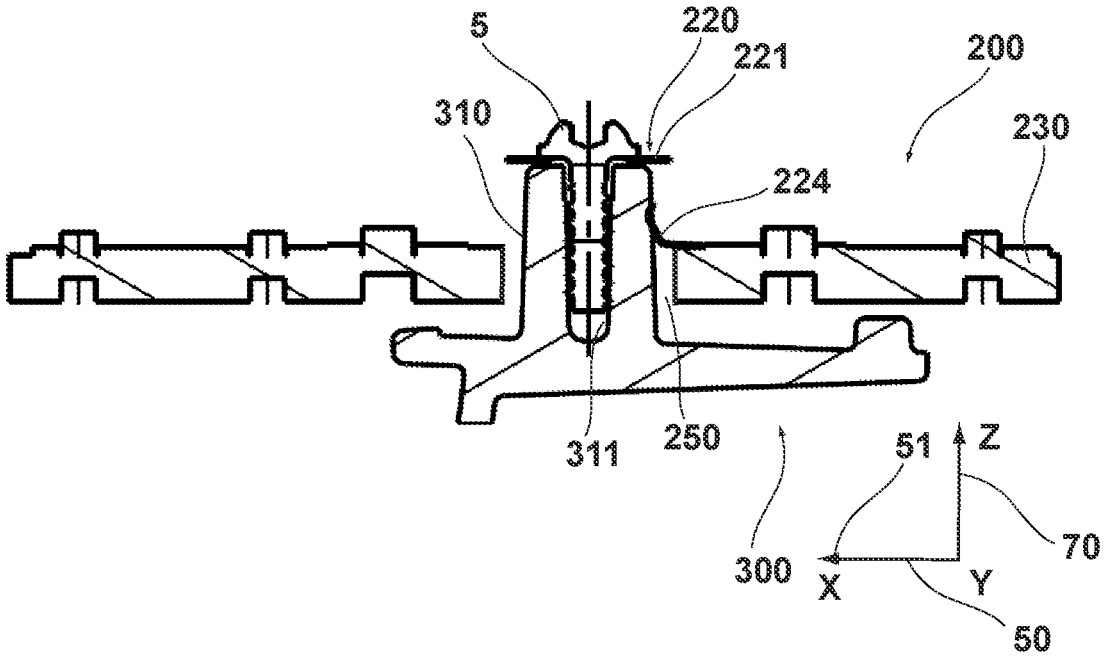
FIG. 5*b* is a side-view onto a section along section line D-D according to FIG. 5*a* with the dome of the reflector traversing through the opening in the light emitting assembly.

FIG. 5*b* depicts analogue to FIG. 4*b* in a sectional side view along section line D-D the dome 310 of the reflector 300 traversing the opening 250 in the baseplate 230 of the light emitting assembly 200. The pretension force of the first spring 224 pushes the dome 310 in the x-direction 51 wherein the dome 310 is free of contact with the baseplate 230. The dome 310 is only in contact with the first spring 224, the second spring and the support 221. Such that an automatic movement and positioning by the force from the first spring 224 and the second spring in the x-y plane perpendicular to the z-axis 70 is possible. The screw 5 is screwed into the screw hole 311 of the dome 310 and clamps the support 221 of the bracket 220 to the dome 310, thus fixing the light emitting assembly 200 and in particular the light emitting diode relative to the reflector 300 in the desired and predetermined position.

Figure 5C:
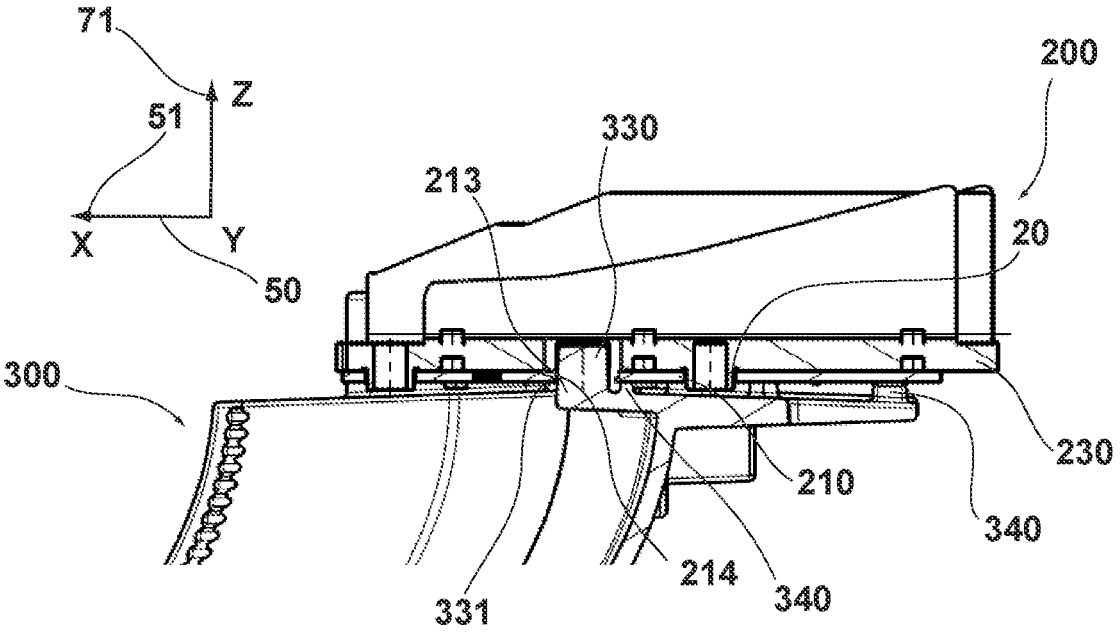
FIG. 5*c* is a side-view onto a section along section line E-E according to FIG. 5*a* with the positioning pin of the reflector positioned in the positioning hole in the printed circuit board of the light emitting assembly.

FIG. 5*c* depicts in a side-view onto a section along section line E-E according to FIG. 5*a*. The printed circuit board 210 directly rests on the of pads 340 of the reflector 300. The pads 340 allow to precisely position the light emitting assembly 200 relative to the reflector 300 in the z-direction 71. The pads 340 also enable to precisely determine an orientation of the x-y plane, in which the printed circuit board 210 extends, relative to the reflector 300. The positioning pin 330 of the reflector 300 is positioned in the positioning hole 213 in the printed circuit board 210. The contact section 331 of the positioning pin 330 is pushed against the wall 214 of the positioning hole 213 by the force of the first spring in the x-direction 51.

Referring to the above described illumination device and cited figures, a particular advantage comes into effect by lowering the light emitting assembly 200 onto the reflector 300 in a direction parallel to the z-axis 70. Wherein the pads 340 form an end stop to the printed circuit board 210 in the z-direction 71. When lowering the illumination device 200 onto the reflector 300 the fixation pin 320 is received in the fixation hole 215, the positioning pin 330 is received in the positioning hole 210 and the dome 310 is received in the bracket 220, wherein the first spring 224 and the second spring 225 exert the force on the dome 310 to position the illumination device 200 relative to the reflector 300 in the x-y plane. In particular the combination of the force from the first spring 224 in the x-direction 51 and the force from the second spring 225 in the y-direction 61 results in a directionality in the x-y plane causing the contact section 331 to contact the wall 214 of the positioning hole 210 forming the end stop in a single particular point in the x-y plane. Consequently, a precise positioning in three dimensions is achieved automatically and failsafe with only one single manual movement in the z-direction 71.

The present invention is not limited by the embodiment described above, which is represented as an example only and can be modified in various ways within the scope of protection defined by the appending patent claims. Thus, the invention is also applicable to different embodiments, in particular of the design of other optical devices such as a lens.

REFERENCE LIST

1 illumination device
3 optical device
4 rivet
5 screw
50 x-axis
51 x-direction
60 y-axis
61 y-direction
70 z-axis
71 z-direction
200 light emitting assembly
210 printed circuit board
211 semiconductor light source
212 light emitting diode
213 positioning hole
214 wall
215 fixation hole
220 bracket
221 support
222 leg
223 bracket hole
224 first spring
225 second spring
230 baseplate
240 cooling device
241 cooling fin
242 cooling base
250 opening
300 reflector
310 dome
311 screwhole
320 fixation pin
330 positioning pin
331 contact section
332 recess
340 pad

The invention claimed is:

1. An illumination device for a vehicle, the illumination device comprising:
- an optical device, the optical device including:
  - a dome projecting from the optical device; and
  - a positioning pin projecting from the optical device in a same direction as the dome;
- a light emitting assembly, the light assembly including:
  - a printed circuit board including a positioning hole for receiving the positioning pin and configured to position the light emitting assembly relative to the optical device;
  - a semiconductor light source; and
  - a bracket, the bracket further including a first spring and a second spring for exerting a pretension force on the dome of the optical device;
  - wherein at least a portion of the pretension force of the first spring acts in a direction perpendicular to a pretension force of the second spring; and
- an opening configured for receiving the optical device.

2. The illumination device according to claim 1, wherein the printed circuit board is attached to a baseplate, on a side facing the optical device.

3. The illumination device according to claim 1, wherein the bracket is positioned on an opposite side of the light emitting assembly facing away from the optical device.

4. The illumination device according to claim 1, wherein the positioning hole comprises a wall forming an end stop to a contact section of the positioning pin.

5. The illumination device according to claim 1, wherein the dome comprises a screw hole and the bracket comprises a bracket hole, and the screw hole and the bracket hole are aligned to one another for receiving a screw and mounting the bracket with the light emitting assembly to the optical device with that screw.

6. The illumination device according to claim 1, wherein the printed circuit board comprises a fixation hole for receiving a fixation pin to avoid a rotational movement of the light emitting unit relative to the optical device.

7. The illumination device according to claim 6, wherein the positioning pin and/or the fixation pin are made from one piece with the optical device.

8. The illumination device according to claim 1, wherein cooling fins are attached to the baseplate.

* * * * *